US010160631B2

(12) United States Patent
Walton

(10) Patent No.: US 10,160,631 B2
(45) Date of Patent: Dec. 25, 2018

(54) METHOD AND APPARATUS FOR DISPENSING ONE OR MORE LIQUIDS FROM A LIQUID STORAGE CONTAINER

(71) Applicant: Cardomon International Limited, Tsimshatsui, Kowlon (HK)

(72) Inventor: Philip A. Walton, Bishop Auckland (GB)

(73) Assignee: Cardomon International Limited, Hong Kong (HK)

( * ) Notice: Subject to any disclaimer, the term of this patent is extended or adjusted under 35 U.S.C. 154(b) by 0 days.

(21) Appl. No.: 15/190,239

(22) Filed: Jun. 23, 2016

(65) Prior Publication Data

US 2017/0369298 A1 Dec. 28, 2017

(51) Int. Cl.
*B67D 1/00* (2006.01)
*B67D 1/08* (2006.01)

(52) U.S. Cl.
CPC ..... *B67D 1/0009* (2013.01); *B67D 1/0004* (2013.01); *B67D 1/0066* (2013.01); *B67D 1/0071* (2013.01); *B67D 1/0857* (2013.01); *B67D 1/0895* (2013.01)

(58) Field of Classification Search
CPC .... B67D 1/0009; B67D 1/001; B67D 1/0004; B67D 1/0005; B67D 1/0066; B67D 1/0067; B67D 1/0068; B67D 1/0071; B67D 1/00857; B67D 1/00895
USPC ..... 222/144, 5, 146.1, 146.6, 129, 129.1; 261/DIG. 7
See application file for complete search history.

(56) References Cited

U.S. PATENT DOCUMENTS 2,462,019 A * 2/1949 Bowman ..... B67D 1/0036 141/104
4,008,832 A * 2/1977 Rodth ..... B67D 1/0861 222/129.1
4,649,809 A * 3/1987 Kanezashi ..... A47J 31/007 141/104
4,764,315 A * 8/1988 Brusa ..... B01F 3/04808 261/123

(Continued)

OTHER PUBLICATIONS

International Search Report dated Oct. 17, 2017 issued in connection with International Patent Application PCT/IB2017/053717, 4 pages.

*Primary Examiner* — Lien Ngo
(74) *Attorney, Agent, or Firm* — Merek, Blackmon & Voorhees, LLC

(57) ABSTRACT

A method and dispensing apparatus for dispensing one or more liquids from a liquid storage container operably connected to the dispensing apparatus. The one or more liquids may include cold water, cold carbonated water, hot water and/or ambient temperature water. The dispensing apparatus preferably is a self-contained dispensing apparatus, i.e., a dispensing apparatus having its own source of liquid. The dispensing apparatus further preferably includes a housing storing a first cooled liquid reservoir and a second cooled liquid reservoir. The first cooled liquid reservoir preferably stores cold water and the second cooled liquid reservoir preferably stores cold carbonated water. A thermal link preferably connects the first cooled liquid reservoir and the second cooled liquid reservoir to cause thermal energy to be transferred between the first cooled liquid reservoir and the second cooled liquid reservoir.

13 Claims, 5 Drawing Sheets

(56) References Cited

U.S. PATENT DOCUMENTS

| | | | | | |
|---|---|---|---|---|---|
| 4,958,747 | A * | 9/1990 | Sheets | B67D 1/0009 | 222/129 |
| 5,152,935 | A * | 10/1992 | Robertson | B01F 3/04808 | 261/140.1 |
| 5,310,088 | A * | 5/1994 | Burrows | B67D 1/0057 | 222/129.1 |
| 5,992,684 | A * | 11/1999 | Russell | B67D 1/006 | 222/1 |
| 7,669,738 | B1 * | 3/2010 | Byers | B67D 1/0004 | 141/196 |
| 9,352,948 | B2 * | 5/2016 | Orita | B67D 3/0009 | |
| 9,440,203 | B2 * | 9/2016 | Cho | F25D 23/126 | |

* cited by examiner

FIG. 2
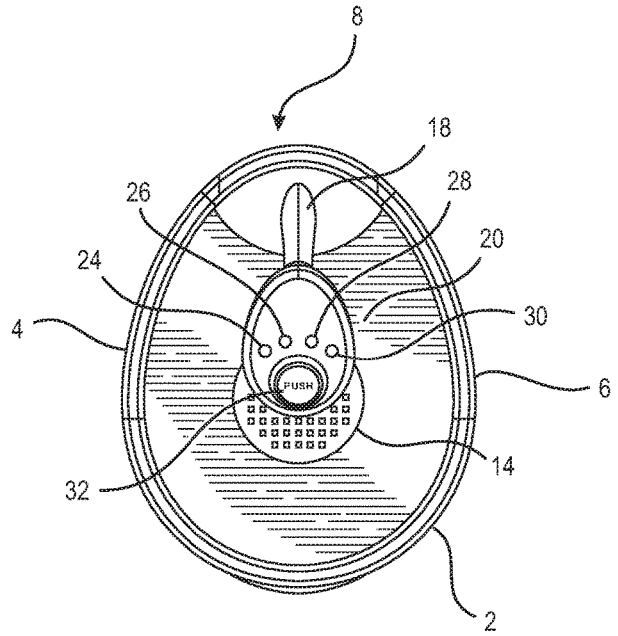
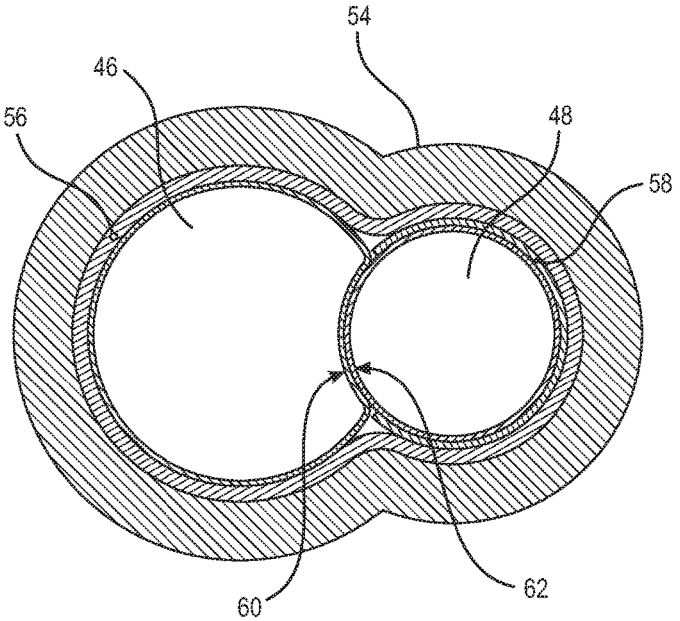
FIG. 6

METHOD AND APPARATUS FOR DISPENSING ONE OR MORE LIQUIDS FROM A LIQUID STORAGE CONTAINER

FIELD OF THE INVENTION

The present invention is directed to a method and dispensing apparatus for dispensing one or more liquids from a liquid storage container operably connected to the dispensing apparatus. The one or more liquids may include cold water, cold carbonated water, hot water and/or ambient temperature water. The dispensing apparatus preferably is a self-contained dispensing apparatus, i.e., a dispensing apparatus having its own source of liquid. The dispensing apparatus further preferably includes a housing storing a first cooled liquid reservoir and a second cooled liquid reservoir. The first cooled liquid reservoir preferably stores cold water and the second cooled liquid reservoir preferably stores cold carbonated water. A thermal link preferably connects the first cooled liquid reservoir and the second cooled liquid reservoir to cause thermal energy to be transferred between the first cooled liquid reservoir and the second cooled liquid reservoir.

BACKGROUND OF THE INVENTION

A number of existing liquid dispensers are capable of dispensing a carbonated liquid (e.g., carbonated water). However, the industry has been unable to solve the considerable technical challenge of controlling the temperature of two separate reservoirs having independent draw-offs that are cooled by a single cooling element (e.g., an evaporator) to prevent freezing of liquid in one or both of the separate reservoirs. Previously known liquid dispensers have additional limitations, disadvantages and/or inherent deficiencies.

The above discussion is merely provided for general background information and is not to be used in any manner to limit the scope of the pending claims or as an aid to determining the scope of the claimed subject matter.

OBJECTS AND SUMMARY OF THE INVENTION

An object of the present invention is to provide a novel and unobvious apparatus for dispensing one or more liquids from a liquid storage container.

Another object of a preferred embodiment of the present invention is to provide a self-contained dispenser, i.e., a dispenser having its own source of liquid that can dispense cold water, cold carbonated water, hot water and ambient temperature water.

A further object of a preferred embodiment of the present invention is to provide a self-contained dispenser that prepares and stores carbonated water ready for draw-off on demand by a user wherein the stored carbonated water is automatically replenished when the stored carbonated water is exhausted.

Yet a further object of a preferred embodiment of the present invention is to provide a dispenser that includes a first cold liquid reservoir and a second cold liquid reservoir wherein the first cold liquid reservoir supplies a cold liquid to the second cold liquid reservoir.

Still another object of a preferred embodiment of the present invention is to provide a dispenser that includes a first cold liquid reservoir and a second cold liquid reservoir and a thermal link connecting the first cold liquid reservoir to the second cold liquid reservoir to cause thermal energy to be transferred between the first cold liquid reservoir and the second cold liquid reservoir to prevent freezing of liquid stored in one of the first cold liquid reservoir and the second cold liquid reservoir.

Still a further object of a preferred embodiment of the present invention is to provide a dispenser that includes a first cold liquid reservoir, a second cold liquid reservoir, a cooling element operably connected to both the first cold liquid reservoir and the second cold liquid reservoir and a cool limiting element to reduce the cooling effect of the cooling element on the second cold liquid reservoir.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to an apparatus for dispensing at least one non-carbonated liquid and at least one carbonated liquid including a housing storing a non-carbonated liquid reservoir and a carbonated liquid reservoir. The non-carbonated liquid reservoir is configured to store a non-carbonated liquid and the carbonated liquid reservoir is configured to store a carbonated liquid. The apparatus also includes at least one spout for dispensing a non-carbonated liquid stored in the non-carbonated liquid reservoir and a carbonated liquid stored in the carbonated liquid reservoir. A thermal link connects the non-carbonated liquid reservoir and the carbonated liquid reservoir. The thermal link is configured to transfer thermal energy between the non-carbonated liquid reservoir and the carbonated liquid reservoir.

Another preferred embodiment of the present invention is directed to an apparatus for dispensing at least one non-carbonated liquid and at least one carbonated liquid. The apparatus includes a housing storing a non-carbonated liquid reservoir and a carbonated liquid reservoir. The non-carbonated liquid reservoir is configured to store a non-carbonated liquid and the carbonated liquid reservoir is configured to store a carbonated liquid. The apparatus further includes a liquid storage container for supplying a non-carbonated liquid to the non-carbonated liquid reservoir. The non-carbonated liquid reservoir is configured to supply a cooled, non-carbonated liquid to the carbonated liquid reservoir. The apparatus further includes at least one spout for dispensing a non-carbonated liquid stored in the non-carbonated liquid reservoir and a carbonated liquid stored in the carbonated liquid reservoir. A thermal link connects the non-carbonated liquid reservoir and the carbonated liquid reservoir. The thermal link is configured to transfer thermal energy between the non-carbonated liquid reservoir and the carbonated liquid reservoir.

A further preferred embodiment of the present invention is directed to an apparatus for dispensing liquids. The apparatus includes a housing storing a first cold liquid reservoir and a second cold liquid reservoir. The first cold liquid reservoir and the second cold liquid reservoir are each configured to store a cooled liquid. The apparatus further includes a liquid storage container for supplying a liquid to the first cold liquid reservoir. The first cold liquid reservoir is configured to supply a cooled liquid from the first cold liquid reservoir to the second cold liquid reservoir. The apparatus further includes at least one spout for dispensing the cooled liquid stored in the first cold liquid reservoir and the cooled liquid stored in the second cold liquid reservoir. A thermal link connects the first cold liquid reservoir and the second cold liquid reservoir. The thermal link is configured to transfer thermal energy between the first cold liquid reservoir and the second cold liquid reservoir.

BRIEF DESCRIPTION OF THE DRAWINGS

FIG. 2 is a plan view of the dispenser depicted in FIG. 1.

FIG. 6 is a schematic of the non-carbonated liquid reservoir, the carbonated liquid reservoir and the cooling assembly formed in accordance with a preferred embodiment of the present invention.

DETAILED DESCRIPTION OF THE PREFERRED EMBODIMENT OF THE INVENTION

Figure 1:
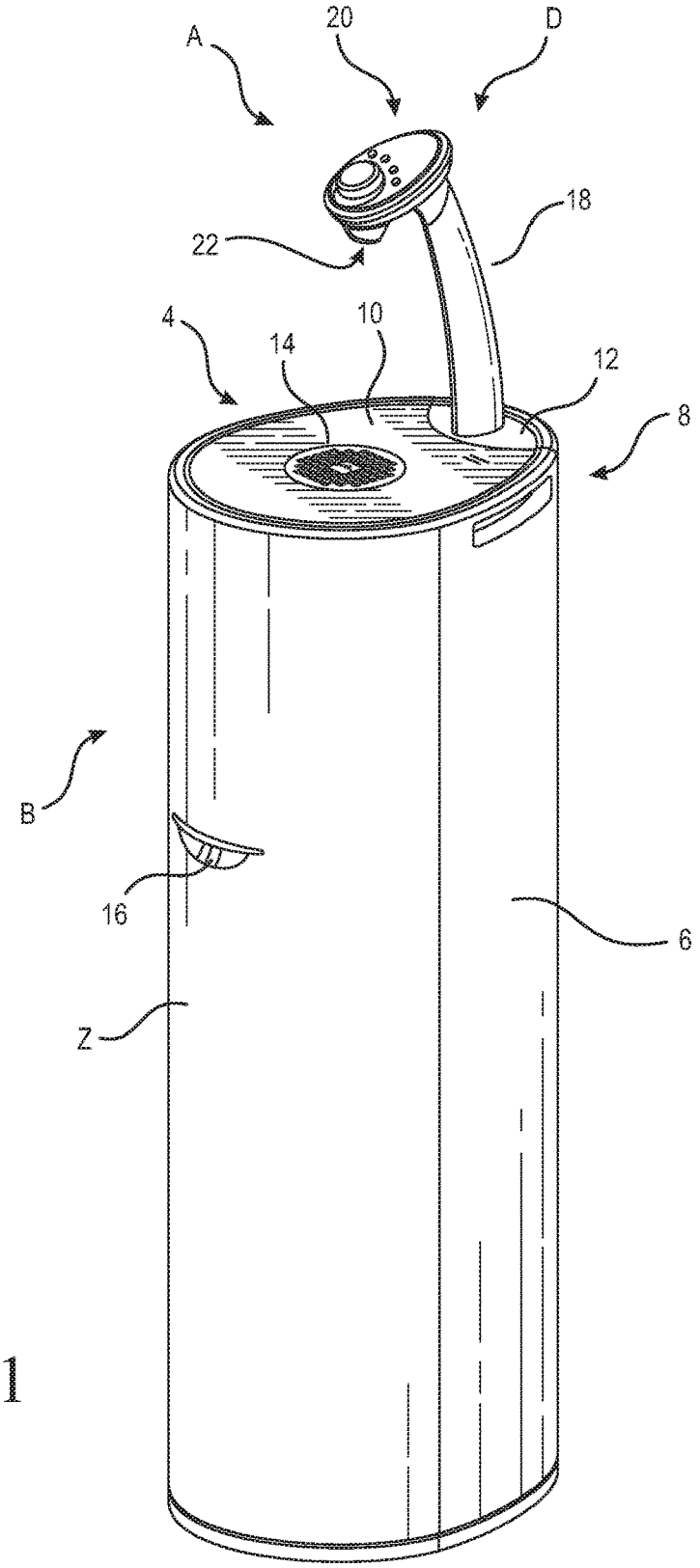
FIG. 1 is a perspective view of a dispenser for dispensing one or more liquids formed in accordance with a preferred embodiment of the present invention.

The preferred forms of the invention will now be described with reference to FIGS. 1-6. The appended claims are not limited to the preferred forms and no term and/or phrase used herein is to be given a meaning other than its ordinary meaning unless it is expressly stated otherwise. The term "liquid" as used herein includes a liquid infused with $CO_2$ gas. For example, carbonated water is a "liquid" as that term is used herein.

FIGS. 1 Through 6

Referring to FIGS. 1 to 6, a liquid dispenser A employing a preferred form of the invention is illustrated in one of many possible configurations. In the most preferred form, liquid dispenser A dispenses cold water, cold carbonated water, hot water and ambient temperature water for human consumption. However, the present invention is not limited to a liquid dispenser that dispenses these liquids. Rather, the liquid dispenser A may dispense fewer, more or other liquids than those described above.

Liquid dispenser A includes a main housing B having a substantially hollow internal cavity for housing components of the liquid dispenser A. Housing B may include a plurality of panels. For example, housing B may include a front panel 2, a left side panel 4, a right side panel 6, a rear panel 8 and top panels 10 and 12. The number of the panels forming main housing B may be readily varied as desired. Top panel 10 may include a drain 14 operably connected to a removable waste container (not shown) housed in main housing B. The waste container may collect liquid passing through drain 14.

One or more of the panels of housing B may be adjustable and/or removable to allow access to the internal components of liquid dispenser A. In this regard, FIG. 3 illustrates how front panel 2 may be readily raised by an individual using handle 16 to access one or more components of liquid dispenser A.

Figure 3:
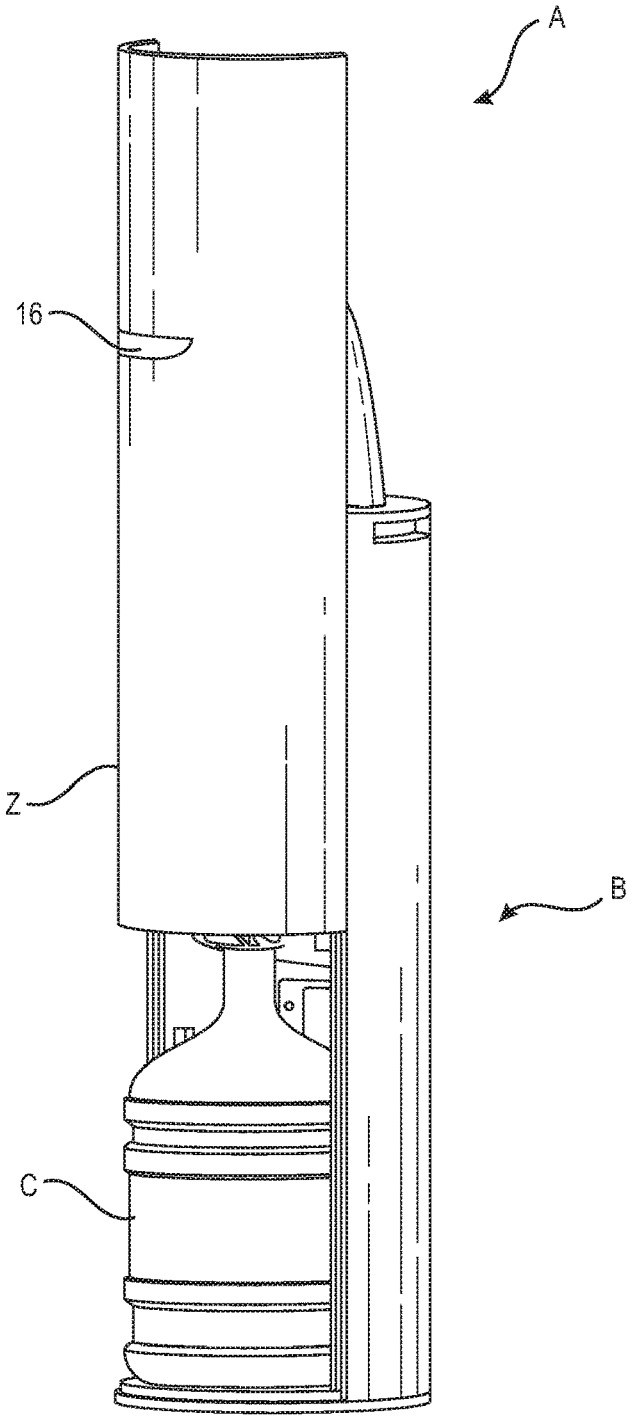
FIG. 3 is a perspective view of the dispenser depicted in FIG. 1 with the front panel of the dispenser housing raised to reveal the liquid storage container positioned in a bottom portion of the housing.

Referring to FIG. 3, dispenser A preferably includes a five-gallon liquid storage container C storing liquid (e.g., water) at ambient temperature. The size of the liquid storage container be varied as desired. Liquid storage container C is preferably removably stored in a lower or bottom portion of main housing B so that when the liquid storage container C is exhausted it can be readily replaced with a new five-gallon liquid storage container C. While the preferred embodiment illustrates a bottom loaded dispenser, the present invention is not limited to bottom loaded dispensers but rather may be used with other types of dispensers including but not limited to top loaded dispensers.

Dispenser A further includes a dispensing assembly D extending upwardly from top panel 12. Dispensing assembly D preferably includes a neck portion 18 housing one or more liquid conveying conduits (not shown) and a head portion 20. Preferably, neck portion 18 houses two liquid conveying conduits, one being dedicated solely for conveying hot water to dispensing nozzle 22 of head portion 20 and the other being dedicated for conveying cold water, cold carbonated water and ambient temperature water to dispensing nozzle 22 of head portion 20. Dispensing nozzle 22 may have two discharge ports, one connected to the conduit conveying hot water and the other connected to the conduit conveying cold water, cold carbonated water and ambient temperature water. Alternatively, a manifold may connect a single dispensing port to the two conduits in neck portion 18. Providing two conduits as described above is one way to avoid an undesirable effect on the actual dispense temperature of liquids dispensed by dispenser A. For example, if the conduit housed in the neck portion 20 is full of hot water after a first dispense cycle, and the next dispense cycle is a cold liquid through the same conduit, the small amount of residual hot water in the conduit can raise the temperature of the cold water dispensed by 2 or 3° F. which may well be perceptible to the user. However, using two conduits as described above avoids this potential issue.

The present invention is not limited to two separate conduits. A single conduit can be used. Where a single conduit is used, other methods can be used to reduce the effect of temperature changes in the dispensed liquid. For example, after each dispense cycle, a small quantity of ambient water can further be dispensed (equal to the volume of the conduit) to fill the conduit with ambient temperature water that will be least affected by temperature change in subsequently dispensed liquids. Another method is after each dispense cycle, introducing a small quantity of gas into the conduit to purge residual water in the conduit. In this case, the conduit is emptied therefore alleviating any tendency of dispensing nozzle 22 to drip.

Referring to FIGS. 1 and 2, head portion 20 includes one or more liquid selection controls. As illustrated, head portion 20 includes cold water selection control 24, hot water selectin control 26, ambient temperature water selection control 28 and carbonated cold water selection control 30. The number, location and type of liquid selection controls may be readily varied as desired. For example, the liquid selection controls may be located on any suitable portion of the housing B. The selection controls can be buttons or any other type of activation device that when interacted with by the user causes the dispenser to operate in a given liquid dispensing mode (e.g., carbonated cold water dispensing mode). The selection controls may be configured to readily identify to a user that a given control has been selected by the user. For example, a selection control may light up when activated by a user. Head portion 20 preferably includes a liquid dispensing control 32 that when activated by a user causes the liquid selected by the user using the selection controls to be dispensed through nozzle 22. Control 32 can be a button or any other type of activation device that when interacted with by the user causes the dispenser to dispense the chosen liquid.

Figure 4:
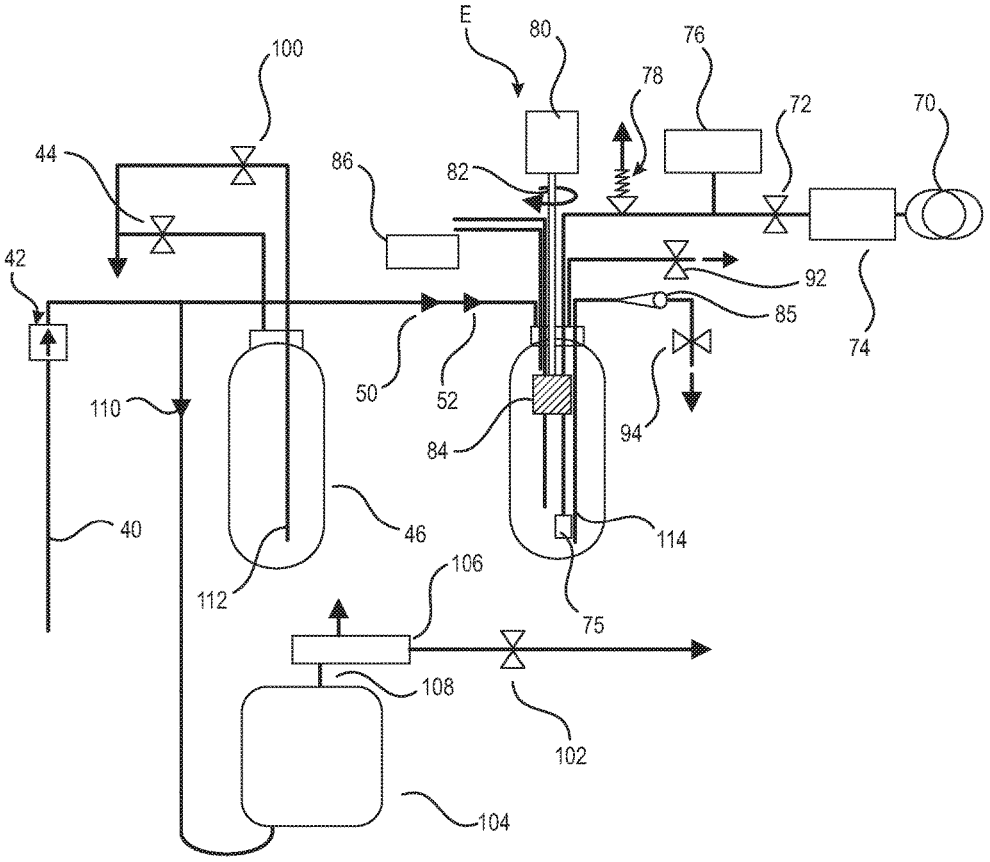
FIG. 4 is a schematic of the liquid flow system formed in accordance with a preferred embodiment of the present invention.
Figure 5:
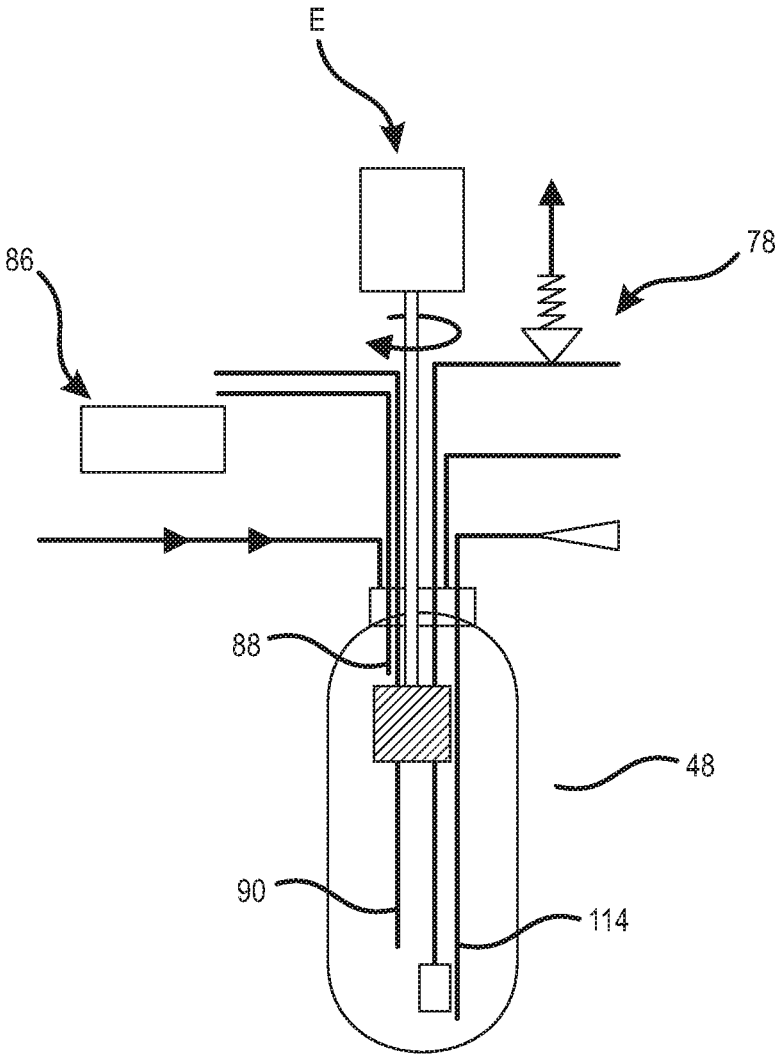
FIG. 5 is a schematic of the carbonated liquid reservoir and various corresponding elements formed in accordance with a preferred embodiment of the present invention.

Referring to FIGS. 4 to 6, the preferred liquid storage and transport assembly will now be described. Preferably, the components of the liquid storage and transport assembly are housed in housing B. A dip tube schematically represented by line 40 extends into a lower portion of liquid storage container C. A pump and associated non-return valve schematically represented by 42, when activated causes liquid from liquid storage container C to be sucked upwardly through line 40.

When a user has activated the ambient temperature water control 28 and has also activated control 32, solenoid valve 44 is opened, solenoid dispensing valves 94, 100 and 102 (described below) remain closed and the pump is activated to convey ambient temperature water from liquid storage container C through solenoid valve 44 and the conduit in neck portion 18 dedicated for conveying cold water, carbonated cold water and ambient temperature water and out nozzle 22.

Cold water reservoir 46 preferably stores cold, non-carbonated water (e.g., 33 to 36° F.) which is pumped from liquid storage container C by pump 42 into reservoir 46. A control system may be used to ensure that reservoir 46 is filled at all appropriate times. Cold carbonated water reservoir 48 preferably stores cold, carbonated water. Cold water is provided to reservoir 48 from reservoir 46. One or more non-return valves schematically represented by 50 and 52 prevent liquid in reservoir 48 from flowing back into reservoir 46.

Referring to FIG. 6, a temperature control assembly is operably associated with reservoirs 46 and 48. The temperature control assembly may include an outer insulating jacket 54, a cooling element 56 and a cooling effect limiting member 58. The cooling element 56 may be any suitable device used to cool liquid stored in reservoirs 46 and 48. For example, cooling element 56 may be one or more refrigerant coils. It should be noted that because reservoir 46 supplies cold water to reservoir 48, the liquid stored in reservoir 48 may be susceptible to freezing. To avoid this undesirable consequence, a thermal link is created between reservoirs 46 and 48 to cause thermal energy to be transferred from reservoir 46 to reservoir 48 to prevent liquid in reservoir 48 from freezing. Specifically, because the reservoir 46 is periodically supplied with ambient temperature water, the liquid in reservoir is typically at a higher temperature than the liquid in reservoir 48. The thermal link transfers this thermal energy from reservoir 46 to reservoir 48 to prevent liquid in reservoir 48 from freezing, i.e., the thermal link acts to heat the liquid in reservoir 48 so that it does not freeze. In its preferred form, the thermal link includes a concave outer surface portion 60 of reservoir 46 that is in direct contact with the convex outer surface portion 62 of reservoir 48. The thermal link may be created in a number of other manners including by using an intermediate element positioned between and in direct contact with both reservoirs 46 and 48. Element 58 is optional and can also be used in conjunction with the thermal link to prevent liquid in reservoir 48 from freezing. Element 58 is preferably formed from a material that will reduce the cooling effect of cooling element 56 on liquid in reservoir 48. The limiting effect of element 58 may be readily controlled through the selection of material that element 58 is formed from.

Carbon dioxide source 70 supplies carbon dioxide gas to reservoir 48 when solenoid valve 72 is open. Pressure regulator 74 ensures that the carbon dioxide gas at a predetermined pressure (e.g., 50 psi) is supplied to reservoir 48 through gas diffuser 75 strategically located in the lower portion of reservoir 48 to create numerous small bubbles thereby increasing the surface contact area. Pressure transducer 76 continuously senses the fluid pressure in reservoir 48 to ensure that the fluid pressure in reservoir 48 is maintained at a desired level. Pressure relief valve 78 prevents fluid pressure in reservoir 48 from exceeding a desired level by automatically opening when the fluid pressure in reservoir 48 reaches a predetermined level.

A stirring assembly E may be used to ensure that the carbon dioxide gas is thoroughly infused in the liquid stored in reservoir 48. Stirring assembly may include a motor 80, a drive shaft 82 and a stirring member 84 (e.g., stirring paddle).

Dispensing regulator 85 is preferably provided to gently lower the pressure of the carbonated water exiting reservoir 48 so that there is minimal effervescence in the carbonated water dispensed by dispenser A.

Level sensor 86 senses the level of carbonated liquid in reservoir 48. Referring to FIG. 5, level sensor includes two sensing tubes 88 and 90. Tube 88 terminates at an upper portion of reservoir 48 and tube 90 terminates at a lower portion of reservoir 48. If tube 90 senses or sees no water, the following procedure is automatically initiated by any suitable control system: (i) solenoid valve 72 is closed; (ii) reservoir solenoid vent valve 92 is opened to vent reservoir 48 to atmosphere; (iii) when pressure in reservoir 48 is at a level equal to normal atmospheric pressure, disable all dispensing solenoid valves (i.e., valves 44, 94, 100 and 102) to stop users interrupting the re-charge process, start the pump 42 causing water to flow into reservoir 46 thus displacing cold water stored in reservoir 46 into carbonation reservoir 48 through one or more non-return valves 50 and 52; (iv) when tube 88 sees or senses water, switch off pump 42, enable cold, ambient and hot dispenser solenoid valves (i.e., 100, 44 and 102, respectively), close the vent valve 92, open the $CO_2$ inlet solenoid valve 72, monitor fluid pressure in reservoir 48 to determine if the pressure is high enough (i.e., at a predetermined level), run stir motor 80 for a pre-determined time, after stir enable carbonated dispensing solenoid valve 94 and close inlet valve 72. Continue to monitor the fluid pressure in reservoir 48 and automatically add $CO_2$ gas as necessary (i.e., by opening inlet solenoid valve 72) to maintain a pre-determined fluid pressure in reservoir 48.

Dispenser A may include a hot water reservoir 104 having a heating element for storing hot water and a steam vent 106. Steam vent 106 may be a float valve or any other suitable device. When steam is present in line 108, the float moves down to open an orifice to vent steam to atmosphere. If there is water in line 108, the float rises to close the orifice. Pump 42 pumps ambient temperature water from storage container C into reservoir 104. A control system may be used to maintain the desired level of hot water in reservoir 104. A non-return valve 110 may be provided to prevent hot water from flowing back into reservoir 46.

When an individual activates hot water selection control 26 and control 32, pump 42 is activated and solenoid dispensing valve 102 is opened while dispensing valves 44, 100 and 94 remain closed. Pump 42 pumps ambient temperature water from liquid storage container C into the bottom of reservoir 104 forcing hot water in the upper portion of reservoir 104 to travel through valve 102 and the conduit housed in neck portion 18 dedicated for hot water only out through nozzle 22.

When an individual activates cold water selection control 24 and control 32, pump 42 is activated and solenoid dispensing valve 100 is opened while dispensing valves 44, 102 and 94 remain closed. Pump 42 pumps ambient temperature water from liquid storage container C into the top of reservoir 46 forcing cold water from the bottom of reservoir 46 to travel upwardly through tube 112 extending into the lower portion of reservoir 46 (tube seen in FIG. 4) through valve 100 and the conduit housed in neck portion 18 dedicated for cold water, cold carbonated water and ambient temperature water out through nozzle 22.

When an individual activates carbonated cold water selection control 30 and control 32, solenoid dispensing valve 94 is opened while dispensing valves 44, 102 and 100 remain closed. The fluid pressure in reservoir 48 causes carbonated cold liquid to flow out of the bottom of reservoir 48 upwardly through tube 114 extending into bottom of reservoir 48 (tube shown in FIGS. 4 and 5 and terminates below diffuser 75) and through regulator 85, valve 94 and the conduit housed in neck portion 18 dedicated for cold water, cold carbonated water and ambient temperature water out through nozzle 22.

A liquid manifold may be used for connecting the two conduits in the neck portion 18 to the corresponding dispensing valves 44, 94, 100 and 102 so that the corresponding liquid can be dispensed from dispenser A on demand. The liquid manifold may also be used to connect container C to reservoirs 46 and 104 as well as connect reservoir 46 to reservoir 48. The liquid manifold may be removably stored in housing B.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. An apparatus for dispensing at least one non-carbonated liquid and at least one carbonated liquid, said apparatus comprising:

(a) a housing storing a non-carbonated liquid reservoir and a carbonated liquid reservoir, the non-carbonated liquid reservoir having an inner hollow cavity being configured to store a non-carbonated liquid and the carbonated liquid reservoir having an inner hollow cavity being configured to store a carbonated liquid, the carbonated liquid reservoir being disposed relative to the non-carbonated liquid reservoir such that no portion of the carbonated liquid reservoir is disposed in the inner hollow cavity of the non-carbonated liquid reservoir;

(b) at least one spout for dispensing a non-carbonated liquid stored in the non-carbonated liquid reservoir and a carbonated liquid stored in the carbonated liquid reservoir; and, (c) a thermal link connecting the non-carbonated liquid reservoir and the carbonated liquid reservoir, the thermal link being configured to transfer thermal energy between the non-carbonated liquid reservoir and the carbonated liquid reservoir, the thermal link including a first portion of the non-carbonated liquid reservoir and a second portion of the carbonated liquid reservoir, the first portion is thermally connected to the second portion such that thermal energy is transferred between the non-carbonated liquid reservoir and the carbonated liquid reservoir and wherein the first portion of the non-carbonated liquid reservoir is an outer sidewall portion of the non-carbonated liquid reservoir which is in direct contact with the second portion of the carbonated liquid reservoir and, wherein the second portion is an outer sidewall portion of the carbonated liquid reservoir.

2. The apparatus as recited in claim 1, wherein:

(a) the thermal link is configured to increase the temperature of liquid in the carbonated liquid reservoir to prevent carbonated liquid in the carbonated liquid reservoir from freezing.

3. The apparatus as recited in 2, further including:

(a) a cooling member surrounding the carbonated liquid reservoir and the non-carbonated liquid reservoir to cool the carbonated liquid in the carbonated liquid reservoir and cool the non-carbonated liquid in the non-carbonated liquid reservoir.

4. The apparatus as recited in claim 3, further including:

(a) an intermediate member being positioned between an inner portion of the cooling member and an outer wall of the carbonated liquid reservoir, the intermediate member being a solid member formed from a material which reduces the cooling effect of the cooling member on the carbonated liquid reservoir.

5. The apparatus as recited in claim 4, wherein:

(a) the intermediate member has an inner arcuate surface and an outer arcuate surface.

6. The apparatus as recited in claim 1, further including:

(a) a source of $CO_2$ gas operably connected to the carbonated liquid reservoir to supply $CO_2$ gas to the carbonated liquid reservoir.

7. An apparatus for dispensing at least one non-carbonated liquid and at least one carbonated liquid, said apparatus comprising:

(a) a housing storing a non-carbonated liquid reservoir and a carbonated liquid reservoir, the non-carbonated liquid reservoir being configured to store a non-carbonated liquid and the carbonated liquid reservoir being configured to store a carbonated liquid;

(b) a liquid storage container for supplying a non-carbonated liquid to said non-carbonated liquid reservoir, said non-carbonated liquid reservoir being configured to supply a cooled, non-carbonated liquid to said carbonated liquid reservoir, wherein no portion of the carbonated liquid reservoir extends into an interior of the non-carbonated liquid reservoir;

(c) at least one spout for dispensing a non-carbonated liquid stored in the non-carbonated liquid reservoir and a carbonated liquid stored in the carbonated liquid reservoir; and, (d) a thermal link connecting the non-carbonated liquid reservoir and the carbonated liquid reservoir, the thermal link being configured to transfer thermal energy between the non-carbonated liquid reservoir and the carbonated liquid reservoir, the thermal link including a first portion of the non-carbonated liquid reservoir and a second portion of the carbonated liquid reservoir and the first portion is in direct contact with the second portion and wherein the first portion is a curved surface of an exterior of the non-carbonated liquid reservoir and the second portion is a curved surface of an exterior of the carbonated liquid reservoir.

8. The apparatus as recited in claim 7, wherein:

(a) the first portion has a concave curvature and the second portion has a convex curvature.

9. The apparatus as recited in claim 7, further including:

(a) a source of $CO_2$ gas operably connected to the carbonated liquid reservoir to supply $CO_2$ gas to the carbonated liquid reservoir;

(b) a pressure transducer operably connected to the carbonated liquid reservoir for sensing fluid pressure in the carbonated liquid reservoir;

(c) a pressure regulator operably connected to the carbonated liquid reservoir and the source of $CO_2$ gas for supplying $CO_2$ gas at a predetermined pressure to the carbonated liquid reservoir; and, (d) a pressure relief valve operably connected to the carbonated liquid reservoir, the pressure relief valve being configured to prevent pressure of the carbonated liquid in the carbonated liquid reservoir from exceeding a predetermined value.

10. An apparatus for dispensing liquids, said apparatus comprising:

(a) a housing storing a first cold liquid reservoir and a second cold liquid reservoir, said first cold liquid reservoir and said second cold liquid reservoir each being configured to store a cooled liquid, the first cold liquid reservoir being a non-carbonated liquid reservoir and the second cold liquid reservoir being a carbonated liquid reservoir;

(b) a liquid storage container for supplying a liquid to said first cold liquid reservoir, said liquid storage container being disposed below an uppermost portion of at least one spout and said first cold liquid reservoir being configured to supply a cooled liquid from said first cold liquid reservoir to said second cold liquid reservoir;

(c) said at least one spout for dispensing the cooled liquid stored in said first cold liquid reservoir and the cooled liquid stored in said second cold liquid reservoir;

(d) a thermal link connecting the first cold liquid reservoir and the second cold liquid reservoir, the thermal link being configured to transfer thermal energy between the first cold liquid reservoir and the second cold liquid reservoir and, wherein the thermal link includes a concave wall portion of said first cold reservoir and a convex wall portion of said second cold liquid reservoir which is in direct contact with said concave wall portion;

(e) a cooling member surrounding the carbonated liquid reservoir and the non-carbonated liquid reservoir to cool the liquid in the carbonated liquid reservoir and the non-carbonated liquid reservoir; and, (f) an intermediate member having a first end and a second end, the intermediate member being positioned between the cooling member and the carbonated liquid reservoir to reduce the cooling effect of the cooling member on the carbonated liquid reservoir and, wherein an exterior surface of the intermediate member directly contacts an inner surface of the cooling member and an inner surface of the intermediate member directly contacts an exterior surface of the carbonated liquid reservoir.

11. The apparatus as recited in claim 10, wherein:

(a) said liquid storage container is disposed in a bottom portion of said housing.

12. The apparatus as recited in claim 10, wherein:

(a) said liquid storage container stores ambient temperature water.

13. The apparatus as recited in claim 10, further including:

(a) a hot liquid reservoir disposed in said housing for storing a hot liquid.

* * * * *